US009063501B2

(12) United States Patent
Hirukawa et al.

(10) Patent No.: US 9,063,501 B2
(45) Date of Patent: Jun. 23, 2015

(54) DEVELOPER ACCOMMODATING UNIT WITH LIGHT GUIDE MEMBER FOR DETECTING REMAINING TONER AMOUNT

(71) Applicant: CANON KABUSHIKI KAISHA, Tokyo (JP)

(72) Inventors: Kuniaki Hirukawa, Susono (JP); Hideki Maeshima, Mishima (JP); Shuichi Gofuku, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/858,406

(22) Filed: Apr. 8, 2013

(65) Prior Publication Data

US 2013/0272727 A1 Oct. 17, 2013

(30) Foreign Application Priority Data

Apr. 16, 2012 (JP) ..... 2012-092800

(51) Int. Cl.
*G03G 15/08* (2006.01)
*G03G 15/00* (2006.01)

(52) U.S. Cl.
CPC ..... *G03G 15/556* (2013.01); *G03G 2215/0894* (2013.01); *G03G 15/0862* (2013.01)

(58) Field of Classification Search
CPC ..... G03G 15/0827; G03G 15/0831; G03G 15/0855; G03G 15/0862; G03G 2215/0891; G03G 2215/0894; G03G 15/556
USPC ..... 399/27, 64
See application file for complete search history.

(56) References Cited

U.S. PATENT DOCUMENTS

| | | | |
|---|---|---|---|
| 6,505,007 | B2 | 1/2003 | Miura et al. |
| 6,553,189 | B2 | 4/2003 | Miyamoto et al. |
| 6,947,686 | B2 | 9/2005 | Kawai et al. |
| 6,968,142 | B2 | 11/2005 | Arimitsu et al. |
| 6,980,758 | B2 | 12/2005 | Murayama et al. |
| 7,046,942 | B2 | 5/2006 | Arimitsu et al. |
| 7,072,594 | B2 | 7/2006 | Hoshi et al. |
| 7,072,603 | B2 | 7/2006 | Tsuzuki et al. |
| 7,088,939 | B2 | 8/2006 | Maeshima et al. |
| 7,127,194 | B2 | 10/2006 | Hoshi et al. |
| 7,158,735 | B2 | 1/2007 | Murayama et al. |
| 7,162,181 | B2 | 1/2007 | Maeshima et al. |
| 7,340,197 | B2 | 3/2008 | Murayama et al. |
| 7,349,649 | B2 | 3/2008 | Hoshi et al. |

(Continued)

FOREIGN PATENT DOCUMENTS

| | | | |
|---|---|---|---|
| JP | 07219412 A | * | 8/1995 |
| JP | 2001318524 | | 11/2001 |

(Continued)

*Primary Examiner* — Robert Beatty
(74) *Attorney, Agent, or Firm* — Fitzpatrick, Cella, Harper & Scinto

(57) ABSTRACT

A developer accommodating unit includes a developer accommodating unit formed by a developer accommodating frame and includes an integrally formed light guide member. The light guide member is mounted through the developer accommodating frame in a state in which an incident portion and an emergent portion are exposed through an incident side opening and an emergent side opening, respectively, and is connected with the developer accommodating frame in a sealed state so that an outside and inside of the developer accommodating chamber are prevented from communicating with each other via the incident side opening and the emergent side opening.

16 Claims, 12 Drawing Sheets

(56) References Cited

U.S. PATENT DOCUMENTS

| | | | | |
|---|---|---|---|---|
| 7,391,981 | B2 | 6/2008 | Okino et al. | |
| 7,813,671 | B2 | 10/2010 | Nittani et al. | |
| 8,019,240 | B2 | 9/2011 | Kakuta et al. | |
| 8,213,828 | B2 | 7/2012 | Murayama et al. | |
| 8,355,648 | B2 | 1/2013 | Hirukawa et al. | |
| 8,369,743 | B2 | 2/2013 | Maeshima et al. | |
| 2002/0061196 | A1* | 5/2002 | Miyamoto et al. | 399/27 |
| 2003/0086715 | A1* | 5/2003 | Miura et al. | 399/27 |
| 2006/0002725 | A1* | 1/2006 | Ishii | 399/27 |
| 2011/0123205 | A1* | 5/2011 | Satomura | 399/27 |
| 2011/0280620 | A1 | 11/2011 | Chadani et al. | |
| 2011/0311272 | A1 | 12/2011 | Nittani et al. | |
| 2012/0177403 | A1 | 7/2012 | Murayama et al. | |
| 2013/0022368 | A1 | 1/2013 | Takarada et al. | |
| 2013/0108318 | A1 | 5/2013 | Maeshima et al. | |
| 2013/0272753 | A1 | 10/2013 | Fukasawa et al. | |

FOREIGN PATENT DOCUMENTS

| | | |
|---|---|---|
| JP | 2002123079 | 4/2002 |
| JP | 2003131479 | 5/2003 |
| JP | 2003167490 | 6/2003 |
| JP | 2007047431 | 2/2007 |
| JP | 2009288304 | 12/2009 |

* cited by examiner

DEVELOPER ACCOMMODATING UNIT WITH LIGHT GUIDE MEMBER FOR DETECTING REMAINING TONER AMOUNT

FIELD OF THE INVENTION AND RELATED ART

The present invention relates to a developer accommodating unit used in an electrophotographic image forming apparatus, and a developing cartridge, a process cartridge and the image forming apparatus which includes the developer accommodating unit.

The electrophotographic image forming apparatus forms an image on a recording material by using an electrophotographic image forming process. Examples of the electrophotographic image forming apparatus may include an electrophotographic copying machine, an electrophotographic printer (e.g., a laser beam printer, an LED printer or the like), a facsimile machine, a word processor, and the like.

The developing unit is a unit for accommodating a developer used in the electrophotographic image forming process and is constituted by a developer accommodating chamber for accommodating the developer, a feeding means for feeding the accommodated developer, and the like. Further, such a developer accommodating chamber and parts relating to the developer accommodating unit are integrally assembled into a cartridge which is detachably mountable to an image forming apparatus main assembly. This cartridge is referred to as a developer cartridge and is used as a cartridge for supplying the developer to the electrophotographic image forming apparatus.

Next, the developing cartridge is prepared by integrally assembling a developing means for developing a latent image on the electrophotographic photosensitive drum, a developing means frame and parts relating to the developing means into a cartridge, which is detachably mountable to the image forming apparatus main assembly. Examples of the developing means may include a developing roller, an application roller, a developing blade and the like. Further, in many cases, the developing cartridge is provided integrally with the developer accommodating unit.

The process cartridge is prepared by integrally assembling the electrophotographic photosensitive drum and process means acting on the photosensitive drum into a cartridge, which is detachably mountable to the image forming apparatus main assembly. Further, examples of the process means may include a charging means, the developing means, a cleaning means and the like, which act on the electrophotographic photosensitive drum. In a typical constitution of the process cartridge, in many cases, the developing unit including the developing means and the like and a cleaning unit including the photosensitive drum, the cleaning means, the charging means, and the like are connected. Further, there are many examples in which the developing unit is integrally provided with the developer accommodating unit.

In a convention image forming apparatus using the electrophotographic image forming process, a cartridge type in which the cartridge such as the developer cartridge, the developing cartridge or the process cartridge is detachably mountable to the image forming apparatus main assembly is employed. In such a cartridge type, in many cases, a function of displaying a remaining printable sheet number so that a user can replace the cartridge at proper timing is added. In order to add such a function, there is a need to detect or estimate a remaining amount of the developer in the cartridge, and various methods have been heretofore proposed.

Of these methods, a light transmission type remaining developer amount detecting method in which an optical path along which light passes through a developer accommodating chamber is formed by a light emitting element such as LED or the like mounted to the image forming apparatus main assembly and a light receiving element such as a photo-transistor and then a remaining amount of the developer is detected from a time of interruption of the optical path by the developer has been widely used (Japanese Laid-Open Patent Application (JP-A) 2001-318524.

In the optical transmission type remaining developer amount detecting method, as a means for guiding remaining light into the developer accommodating chamber, a light-incident-side light guide member and a light-emergent-side light guide member are provided through the developer accommodating unit. The light-incident-side light guide member guides the detection light emitted from the light emitting element such as LED into the developer accommodating chamber. Further, the light-emergent-side light guide member guides the detection light passing through the inside of the developer accommodating chamber to the light receiving element such as the photo-transistor provided outside the developer accommodating chamber. In many cases, the light-incident-side light guide member and the light-emergent-side light guide member are provided as separate members (JP-A 2003-131479).

However, in the case where the light-incident-side light guide member and the light-emergent-side light guide member are provided as separate members, increases in the number of parts and the number of assembling steps are caused. Further, the light-incident-side light guide member and the light-emergent-side light guide member are individually mounted and therefore there was a possibility that accuracy of remaining amount detection is lowered due to relative mounting error. Therefore, a method in which the light-incident-side light guide member and the light-emergent-side light guide member are integrally provided has been proposed (JP-A 2003-167490).

However, when the light guide member prepared by integrally providing the light-incident-side light guide member and the light-emergent-side light guide member which are used for detecting the remaining amount of the developer as described above is constituted by only a transparent material, there is the case where the remaining amount detection accuracy is lowered. This is because the light emitted from the light emitting element provided to the apparatus main assembly enters the developer accommodating chamber from a portion other than a light-incident-side light guide portion to increase light quantity or because reflection light reflected by an outer wall portion other than the incident portion and emergent portion of the light guide member is erroneously detected by the light receiving element provided to the apparatus main assembly.

As a means for preventing the lowering in remaining amount detection accuracy, a method in which an outer wall of a frame constituting the developer accommodating chamber is exposed at a portion where the detection light emitted from the light emitting element is reflected toward the light receiving element without passing through the light guide member has been proposed (JP-A 2007-47431). Further, also a method in which the transparent member is covered with an opaque (non-transparent) member by two-color molding has been proposed (JP-A 2009-288304).

However, depending on a shape of a peripheral portion of the light guide member, there is a possibility that the light is reflected in the image forming apparatus main assembly in a complicated manner, and therefore there is a possibility that the influence of stray light cannot be sufficiently suppressed only by exposing the outer wall at a specific portion. Further, in the method in which the transparent member is covered with the opaque member by the two-color molding, there was a possibility that a cost of parts is increased.

SUMMARY OF THE INVENTION

The present invention is a further development of the above-described conventional constitutions. A principal object of the present invention is to provide, in the case where a light guide member for detecting a remaining developer amount is integrally formed, a developer accommodating unit capable of satisfactorily detecting the remaining developer amount while suppressing an increase in cost and suppressing the influence of stray light.

Another object of the present invention is to provide a developing cartridge, a process cartridge and an image forming apparatus which include the developer accommodating unit.

According to an aspect of the present invention, there is provided a developer accommodating unit, usable with an electrophotographic image forming apparatus, for accommodating a developer for an electrophotographic image forming process, the developer accommodating unit comprising: a developer accommodating chamber, formed by a developer accommodating frame, for accommodating the developer; and a light guide member, provided through the developer accommodating frame, for detecting a remaining toner amount, wherein the light guide member includes a light-incident-side light guide portion for guiding detection light coming from a light emitting element provided outside the developer accommodating chamber to an inside of the developer accommodating chamber and includes a light-emergent-side light guide portion for guiding the detection light passing through the inside of the developer accommodating chamber to a light receiving element provided outside the developer accommodating chamber, and the light-incident-side light guide portion and the light-emergent-side light guide portion are integrally formed, wherein the light-incident-side light guide portion includes an incident portion on which the detection light is incident, and includes a light-emergent-side window through which the detection light emerges into the developer accommodating chamber, wherein the light-emergent-side light guide portion includes a light-incident-side window on which the detection light passing through the inside of the developer accommodating chamber is incident, and includes an emergent portion from which the detection light emerges toward the light receiving element, wherein the developer accommodating frame includes a light guide member mounting portion for mounting the light guide member, the light guide member mounting portion including an incident side opening and an emergent side opening for exposing the incident portion and the emergent portion, respectively, to the outside of the developer accommodating chamber, and wherein the light guide member is mounted to the developer accommodating frame in a state in which the incident portion and the emergent portion are exposed through the incident side opening and the emergent side opening, respectively, and is connected with the developer accommodating frame in a sealed state so that the outside and inside of the developer accommodating chamber are prevented from communicating with each other via the incident side opening and the emergent side opening.

These and other objects, features and advantages of the present invention will become more apparent upon a consideration of the following description of the preferred embodiments of the present invention taken in conjunction with the accompanying drawings.

Figure 4:
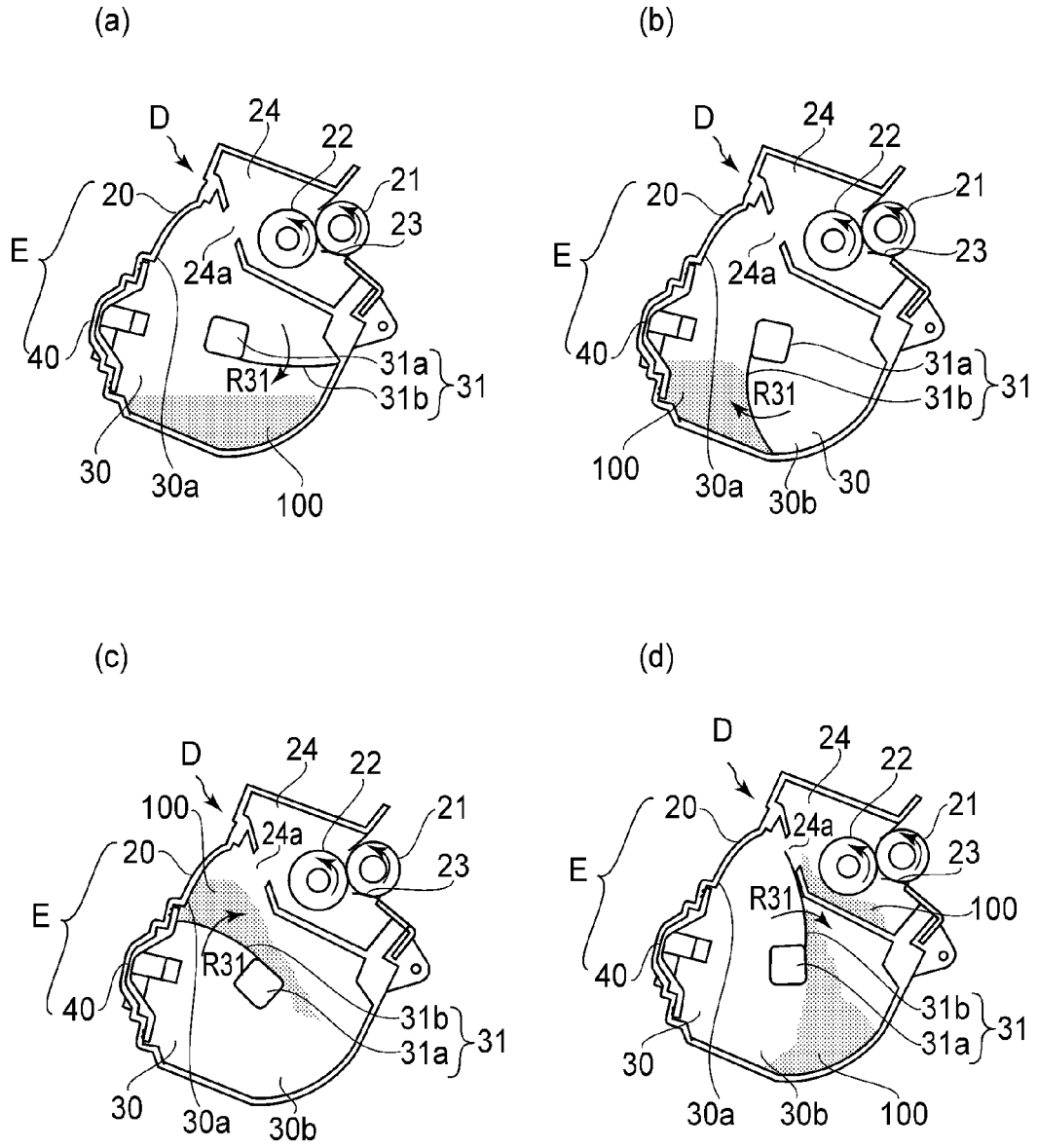

Parts (a) to (d) of FIG. 4 are schematic views for illustrating a toner stirring operation of a developing unit in the embodiment.

Figure 5:
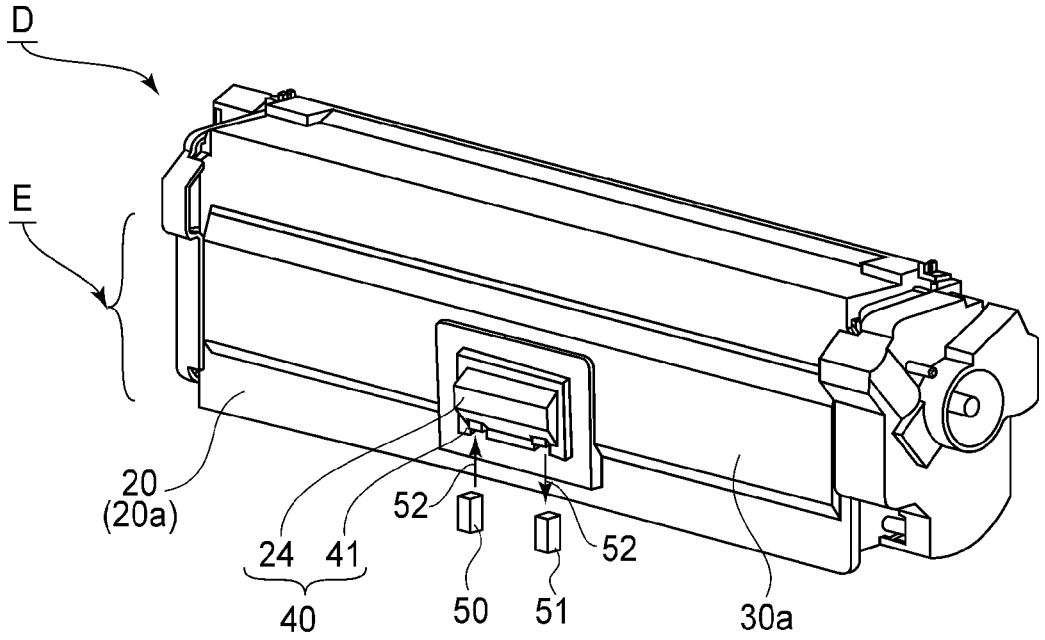

FIG. 5 is an outer appearance of a remaining amount detecting means in the embodiment.

Figure 6:
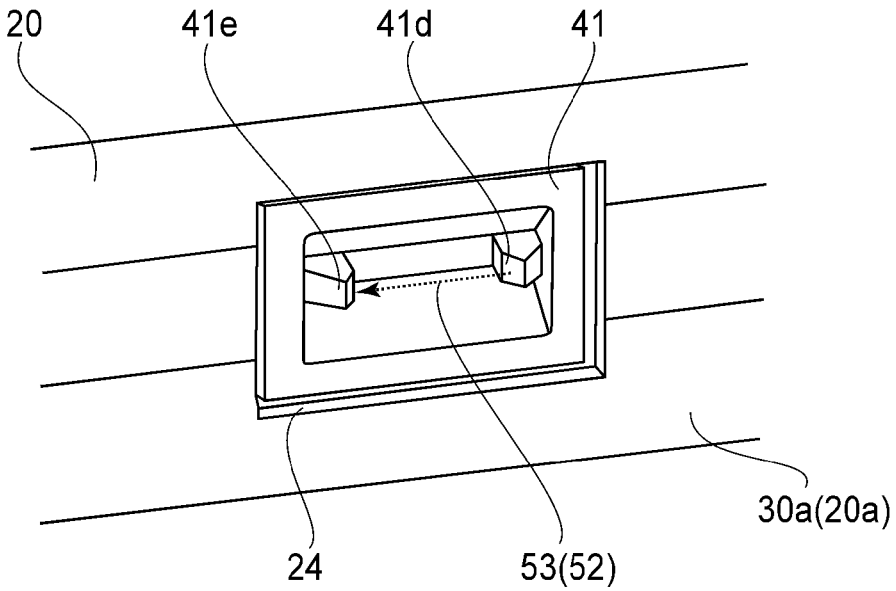

FIG. 6 is a schematic view of the remaining amount detecting means as seen from an inside of a toner accommodating chamber.

Figure 7:
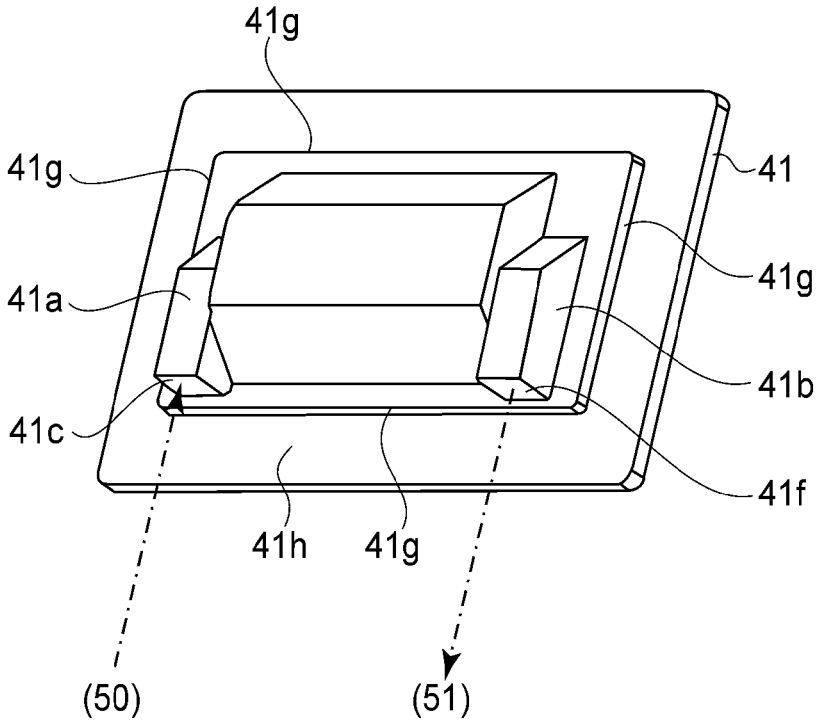

FIG. 7 is an outer appearance of a light guide member in the embodiment.

Figure 8:
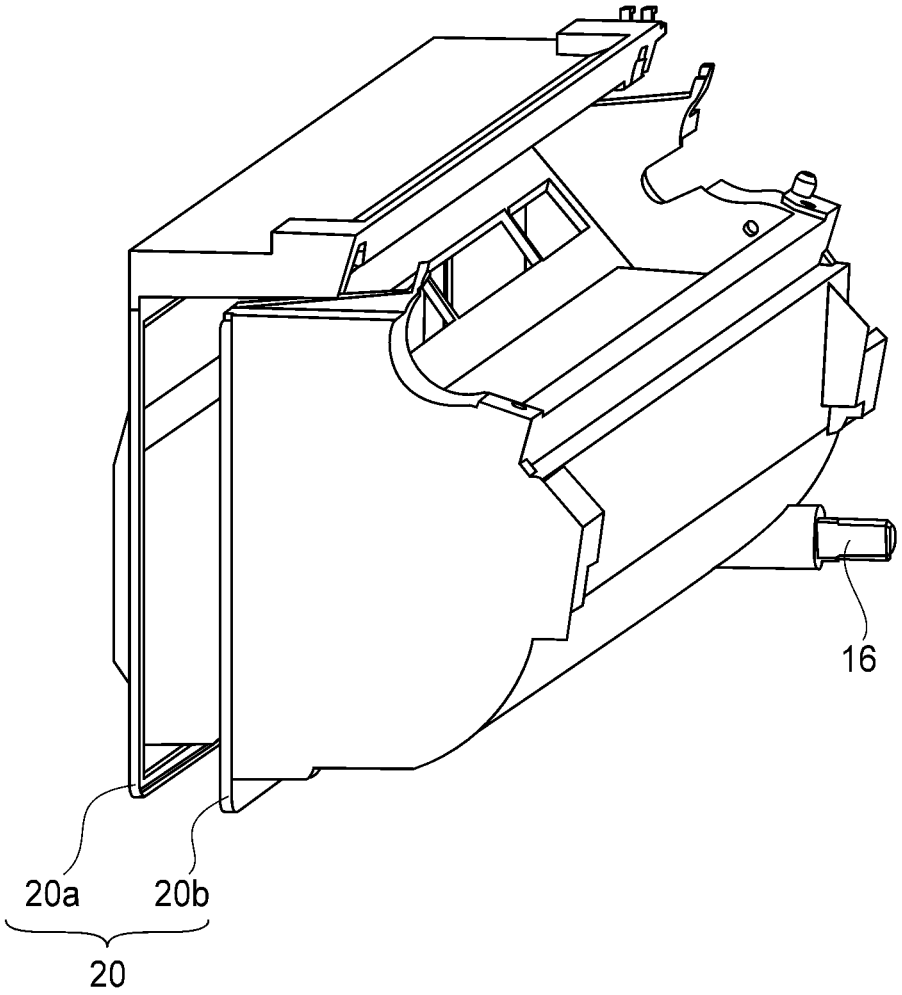

FIG. 8 is a schematic view for illustrating a structure of a developer device frame in the embodiment.

Figure 9:
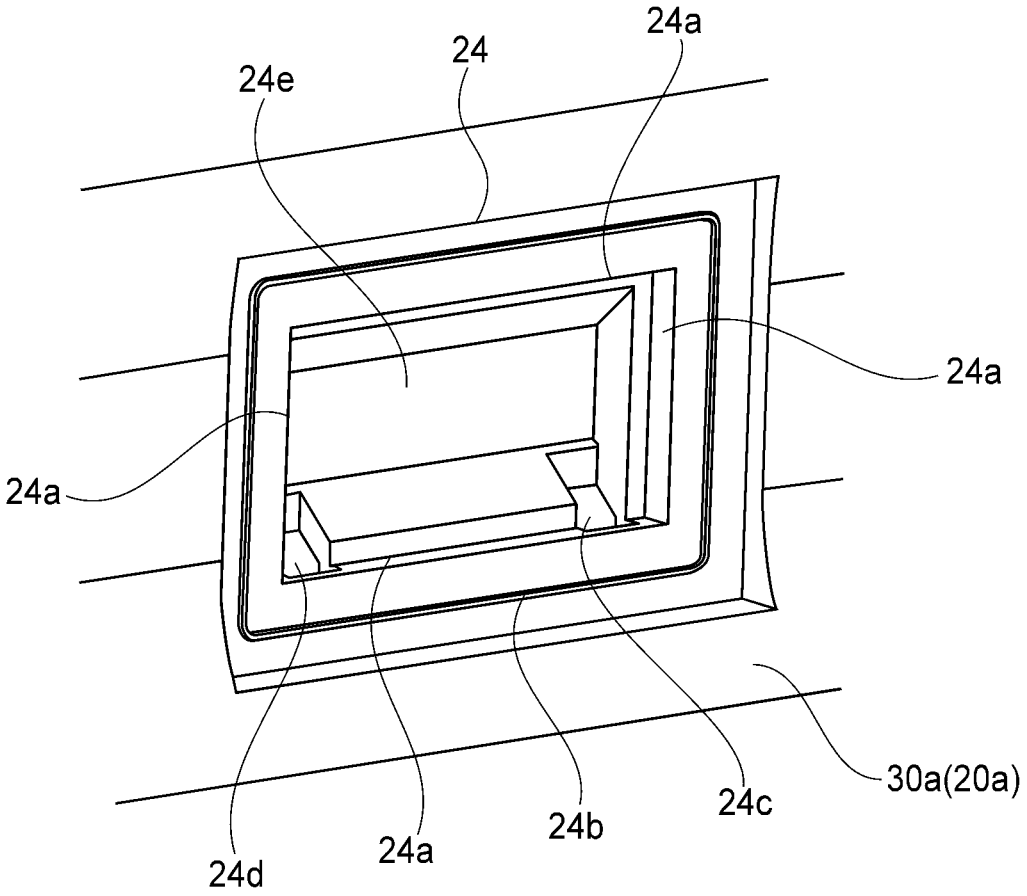

FIG. 9 is a schematic view for illustrating the remaining amount detecting means and its periphery of a first developing device frame in the embodiment.

Figure 10:
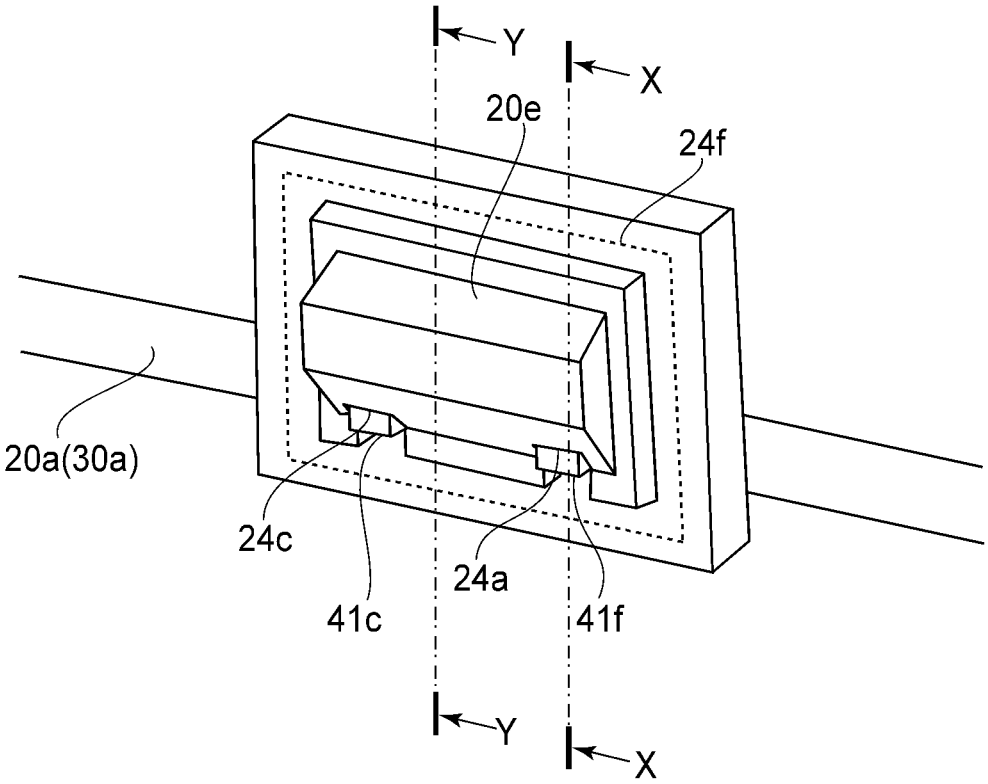

FIG. 10 is an outer appearance of the first developing device frame to which the light guide member in the embodiment is mounted.

Figure 11:
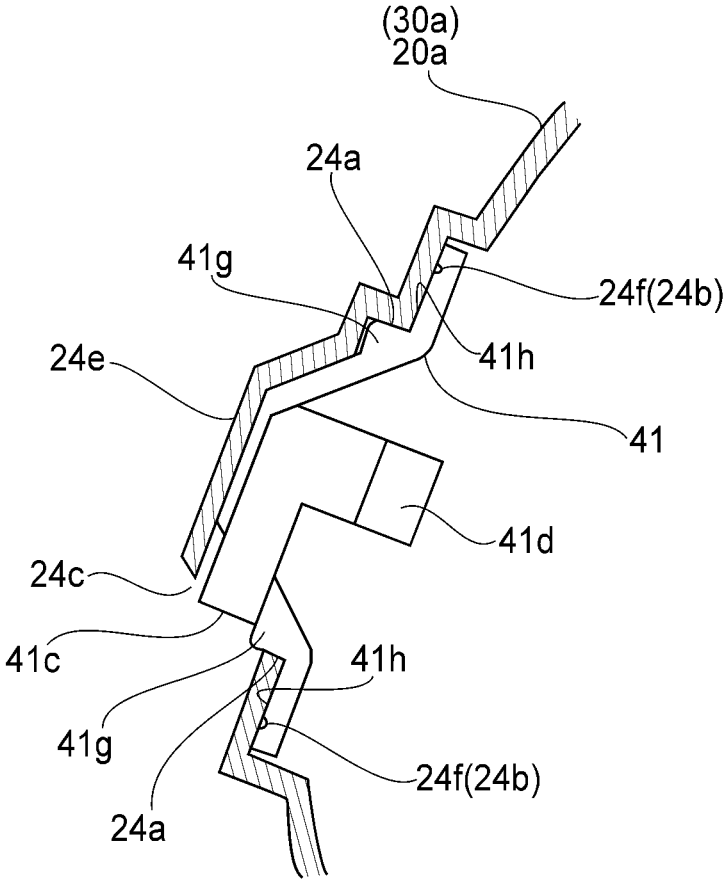

FIG. 11 is a sectional vie of the remaining amount detecting means in the embodiment taken along X-X line indicated in FIG. 10 in the embodiment.

Figure 12:
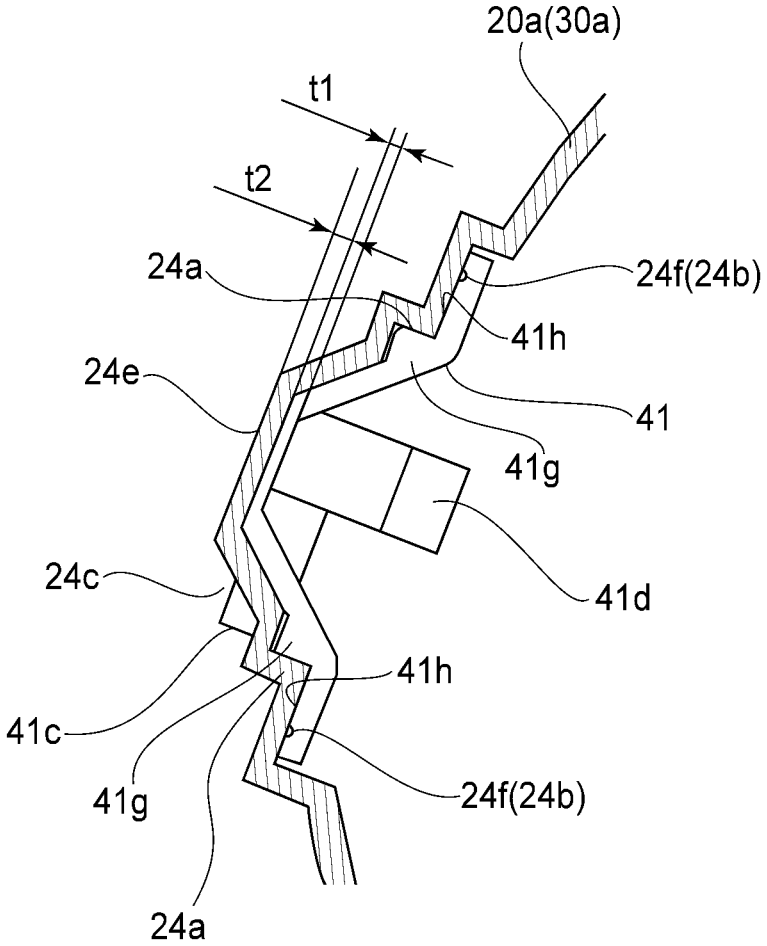

FIG. 12 is a sectional vie of the remaining amount detecting means in the embodiment taken along Y-Y line indicated in FIG. 10 in the embodiment.

Figure 1:
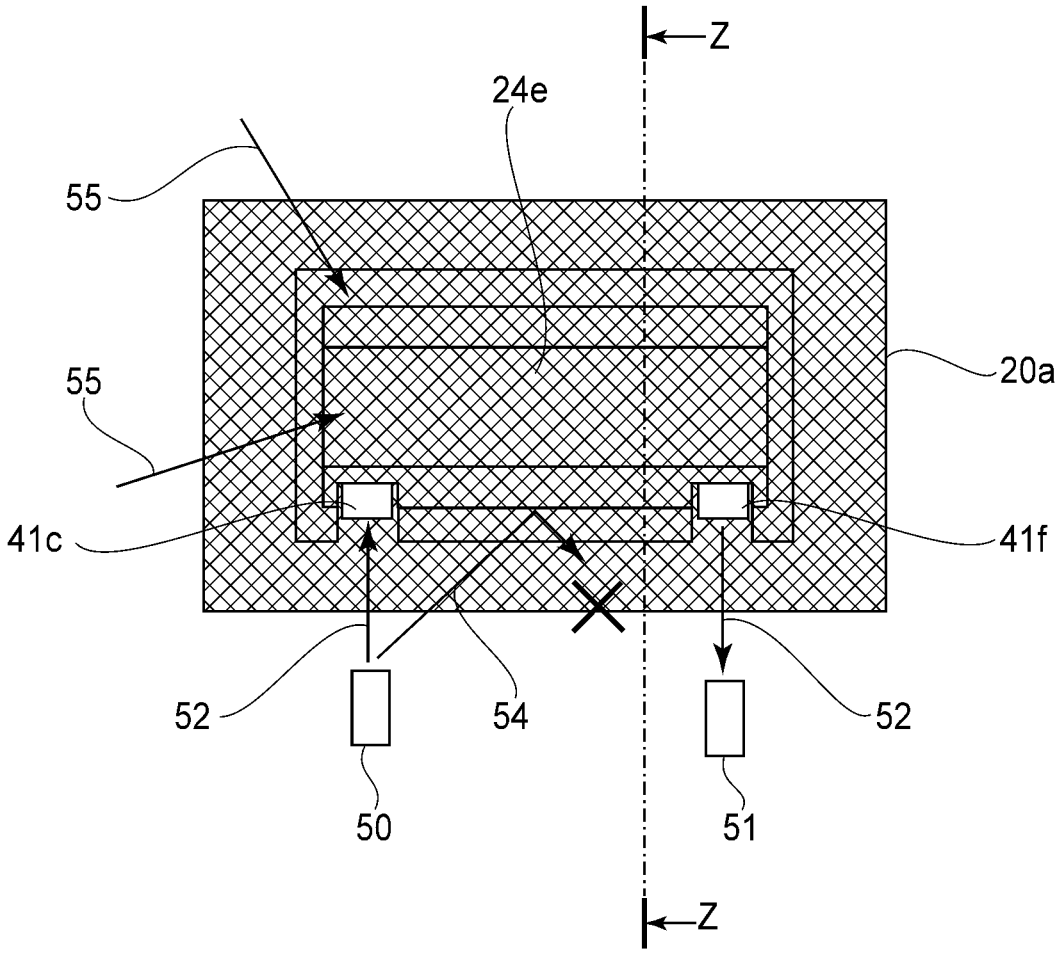
FIG. 1 is an outer appearance showing a state during remaining amount detection in an embodiment.
Figure 13:
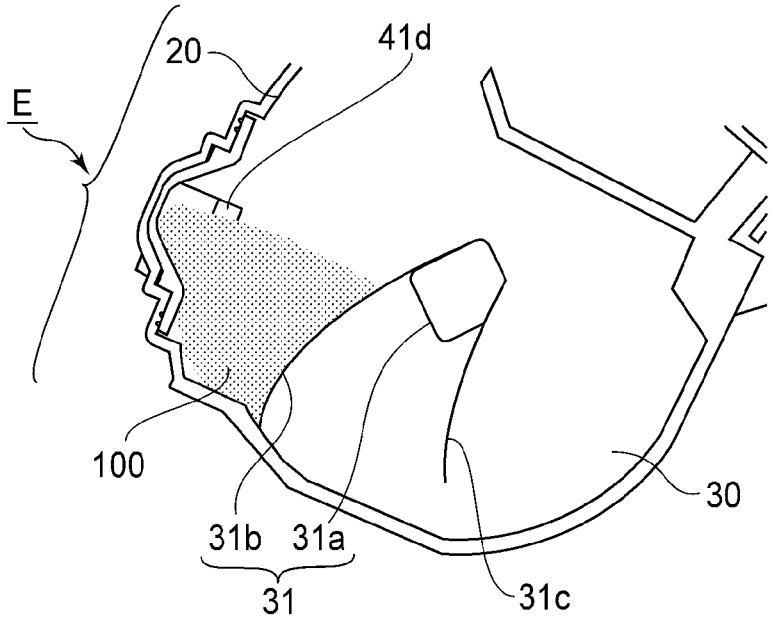

FIG. 13 is a sectional view of the remaining amount detecting means, taken along Z-Z line indicated in FIG. 1, during passing of the toner on the remaining amount detecting means in the embodiment.

Figure 14:
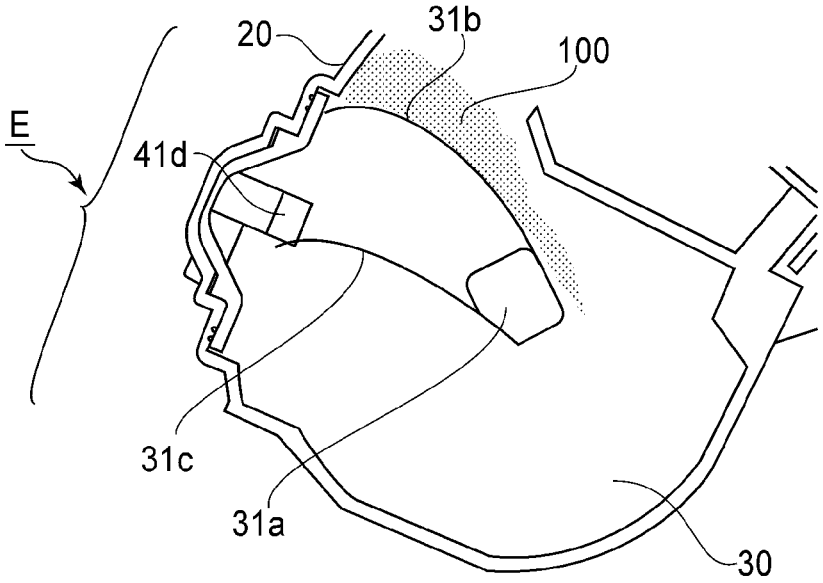

FIG. 14 is a sectional view of the remaining amount detecting means, taken along Z-Z line indicated in FIG. 1, after passing of the toner on the remaining amount detecting means in the embodiment.

DESCRIPTION OF THE PREFERRED EMBODIMENTS

Embodiment

Hereinbelow, an embodiment of the developer accommodating unit according to the present invention and a process cartridge including the developer accommodating unit will be described with reference to FIGS. 1 to 14. Incidentally, in this embodiment, a developer is described as a toner.

1. Structure of Electrophotographic Image Forming Apparatus.

Figure 2:
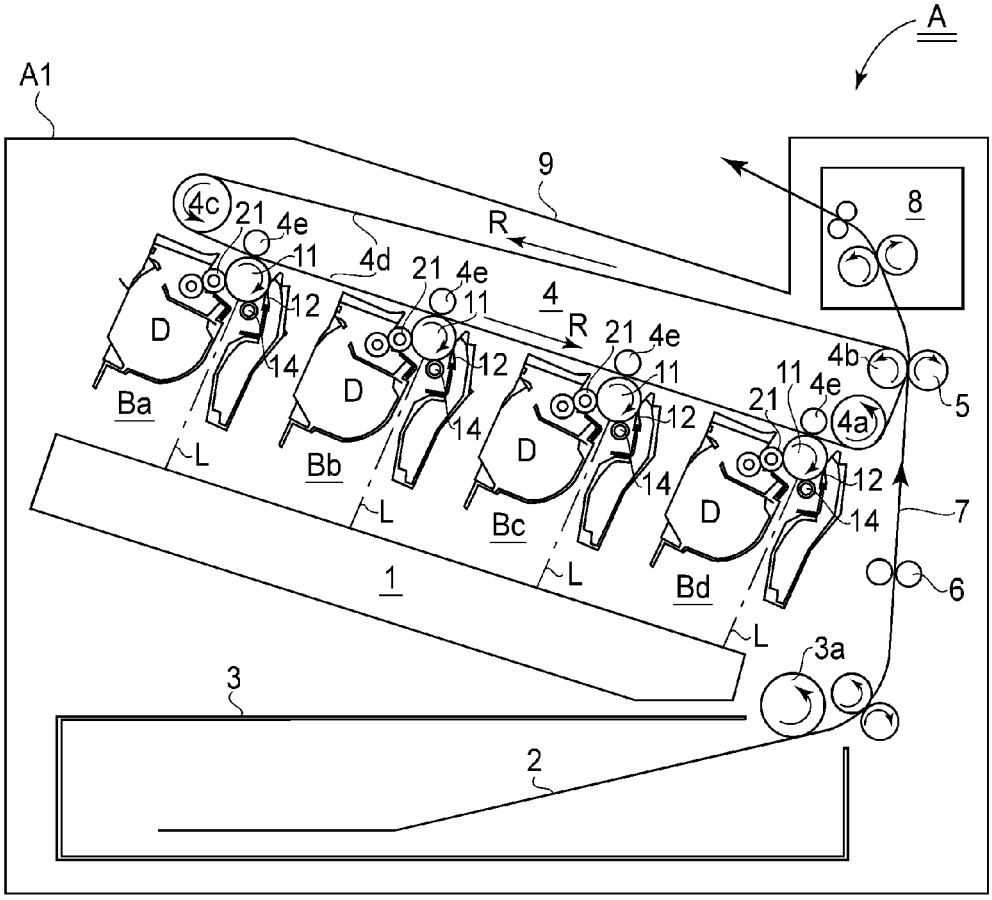
FIG. 2 is a schematic view for illustrating a structure of an electrophotographic image forming apparatus in which a process cartridge according to the embodiment is mounted.

First, with reference to FIG. 2, an electrophotographic image forming apparatus A to which the embodiment of the present invention is applied will be described. This electrophotographic image forming apparatus A is a four-color based full-color laser beam printer and is of the type in which first to fourth process cartridges B (Ba to Bd) are mounted detachably to predetermined mounting portions of an image forming apparatus main assembly A1 and then is used.

The respective process cartridges B are the same electrophotographic process mechanism. As described later, each process cartridge B includes an electrophotographic photosensitive drum 11 and process means, acting on the drum 11, such as a charging roller 11, a developing unit D and a cleaning blade 12.

In the developing unit D of the first cartridge Ba, a toner of yellow (Y) is accommodated. In the developing unit D of the second cartridge Bb, a toner of magenta (M) is accommodated. In the developing unit of the third cartridge Bc, a toner of cyan (C) is accommodated. In the developing unit D of the fourth cartridge Bd, a toner of black (K) is accommodated.

Below the respective cartridges B, a laser scanner unit 1 as an image information exposure means (optical system) with respect to the drum 1 of each cartridge B is provided. Further, in an upper side of the respective cartridges B, an intermediary transfer unit 4 is provided. The intermediary transfer unit 4 includes a driving roller 4*a*, a secondary transfer opposite roller 4*b*, a tension roller 4*c* and an intermediary transfer belt 5 extended and stretched around these rollers. Each drum 11 of the associated cartridge B contacts a lower surface of a lower-side belt portion at its upper surface portion. The contact portion is a primary transfer portion.

Inside the lower-side belt portion of the belt 4*d*, first to fourth (four) primary transfer rollers 4*e* opposed to the drums 11 via the belt 4*d* are provided. Outside a portion of the belt 4*d* where the belt 4*d* is wound about the secondary transfer opposite roller 4*b*, a secondary transfer roller 5 is provided. A contact portion between the belt 4*b* and the secondary transfer roller 5 is a secondary transfer portion. At a lower portion of the inside of the image forming apparatus main assembly A1, a sheet feeding cassette 3 in which sheets of a recording material 2 are accommodated is provided.

An operation for forming a full-color image is as follows. A control circuit portion (not shown) starts an image forming operation of the image forming apparatus on the basis of a print start signal. That is, in synchronism with timing of image formation, the drums 11 of the first to fourth cartridges B (Ba to Bd) are rotationally driven in the clockwise direction of arrows in FIG. 2 at a predetermined speed. The belt 4*d* is also rotationally driven in the counterclockwise direction of an arrow R (in the same direction as the rotational direction of the drums 11 at a speed corresponding to the speed of the drums 11. Also the laser scanner unit 1 is driven.

In synchronism with this motion, in each cartridge B, the surface of the drum 11 is electrically charged uniformly to a predetermined polarity and a predetermined potential by the charging roller 11 to which a predetermined charging bias is applied. The laser scanner unit 1 subjects the surface of each drum 11 to scanning exposure to a laser beam L modulated depending on an image information signal of each of the colors of Y, M, C and K. As a result, an electrostatic latent image depending on the image information signal of the corresponding color is formed on the surface of each drum 11. The formed electrostatic latent image is developed as a toner image by the developing roller 21 of the developing unit D.

By the electrophotographic image forming process operation as described above, on the drum 11 of the first cartridge Ba, a Y toner image corresponding to a yellow component of a full-color image is formed. Then, the toner image is primary-transferred onto the belt 4*d* at the primary transfer portion of the cartridge Ba. On the drum 11 of the second cartridge Bb, an M toner image corresponding to a magenta component of the full-color image is formed. Then, the toner image is primary-transferred superposedly onto the Y toner image which has already been formed on the belt 4*d* at the primary transfer portion of the cartridge Bb.

On the drum 11 of the third cartridge Bc, a C toner image corresponding to a cyan component of the full-color image is formed. Then, the toner image is primary-transferred superposedly onto the Y and M toner images which have already been formed on the belt 4*d* at the primary transfer portion of the cartridge Bc. On the drum 11 of the fourth cartridge Bd, a K toner image corresponding to a black component of the full-color image is formed. Then, the toner image is primary-transferred superposedly onto the Y, M and C toner images which have already been transferred on the belt 4*d* at the primary transfer portion of the cartridge Bd.

To the first to fourth primary transfer rollers 4*e*, at predetermined control timing, a primary transfer bias of a predetermined potential and an opposite polarity to a charge polarity of the toner is applied.

In this way, a full-color unfixed toner image of four colors of Y, M, C and K is synthetically formed on the moving belt 4*d*.

The unfixed toner image is conveyed by further rotation of the belt 4*d* to reach the secondary transfer portion. The surface of the drum 11 after the primary transfer of the toner image on the belt 4*d* in each cartridge B is cleaned by removing a primary-transfer residual toner by the cleaning blade 12, and is subjected to a subsequent image forming step.

On the other hand, the recording material 2 in the sheet feeding cassette 3 is separated one by one by a sheet feeding roller 3*a* at predetermined control timing and then is conveyed to the secondary transfer portion after being passed through a conveying path 7 including a registration roller pair 6 and the like. To the secondary transfer roller 5, at predetermined control timing, a secondary transfer bias of the predetermined potential and an opposite polarity to the toner charge polarity is applied. As a result, in a process in which the recording material 2 is nipped and conveyed at the secondary transfer portion, the superposed four color toner images are successively and collectively secondary-transferred from the belt 4 onto the surface of the recording material 2.

The recording material 2 coming out of the secondary transfer portion is separated from the belt 4*d* and then is conveyed to a fixing unit 8. Thereafter, the toner image is heated and pressed while being nipped and conveyed at a fixing nip as a press-contact portion between a fixing member and a pressing member of the fixing unit 8, so that the toner image is fixed on the recording material 2. The recording material 2 coming out of the fixing unit 8 is discharged as a full-color image formed production on a discharge portion 9.

2. Structure of Process Cartridge

Figure 3:
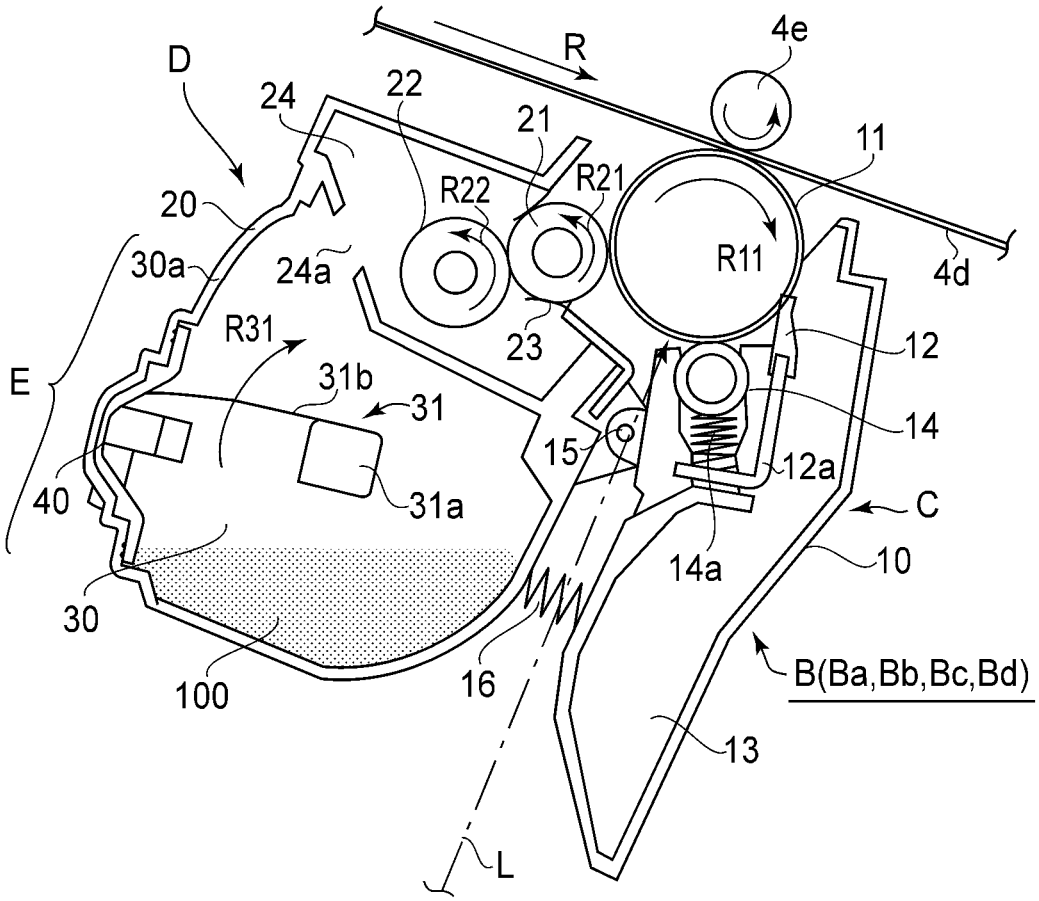
FIG. 3 is a schematic view for illustrating the process cartridge in the embodiment.

FIG. 3 is a schematic cross-sectional view showing a structure of the process cartridge B in this embodiment. The first to fourth (four) process cartridges B (Ba to Bd) are the same electrophotographic process mechanism except that the colors of toners 100 accommodated in toner accommodating chambers 30 of the respective developing units D are different from each other as described above. Each cartridge B includes a cleaning unit C and the developing unit D, and the developing unit D is supported rotatably by a supporting pin 15 as a rotation shaft relative to the cleaning unit C.

The cleaning unit C is constituted by assembling, with a cleaning (device) frame 10, the drum 11 and the charging roller 14 and the cleaning blade 12 which are used as the process means acting on the drum 11. The drum 11 is shaft-supported and held rotatably relative to the cleaning frame 10. The charging roller 14 is shaft-supported and held rotatably relative to the cleaning frame 10 and is urged toward the drum 11 by an urging member 14*a*, so that the charging roller 14 is rotated by rotation of the drum 11. The cleaning blade 12 is provided in a state in which its supporting metal plate 12*a* is fixed on the cleaning frame 10 and in which its edge is contacted counterdirectionally to the surface of the drum 11.

The developing unit D is constituted by the developing means including a developing roller 21, an application roller 22, a developing blade 23 and the like, a developing device frame (developer accommodating frame) 20 for supporting the developing means, and a toner accommodating unit E provided integrally with the developer device frame 20. In a toner accommodating chamber (developer accommodating chamber) 30 of the toner accommodating unit E, the toner 100 as the developer is accommodated.

Further, in the toner accommodating chamber 30, a stirring member 31 for stirring the toner 100 accommodated in the toner accommodating chamber 30 and for feeding the toner 100 to a developing chamber 24 through an operating 24*a* is provided. The stirring member 31 is constituted by a stirring shaft 31*a* rotatable by an external driving force and a flexible stirring blade 31*b* which is mounted on the stirring shaft 31*a* and which is rotated together with the stirring shaft 31*a*.

In each cartridge B, in a state in which the cartridge B is mounted at a predetermined mounting portion of the image forming apparatus main assembly A1 in a predetermined mounting manner, a first main assembly drive transmission member (not shown) in the image forming apparatus main assembly A1 side is engaged with a drum coupling (not shown) of the cleaning unit C. Further, a second main assembly drive transmission member (not shown) of the image forming apparatus main assembly A1 side is engaged with a developing device driving force input portion (not shown) of the developing unit D. Further, an output electric contact (not shown) in the image forming apparatus main assembly A1 side is electrically conducted to an input electric contact (not shown) in the cartridge B side.

The driving force is inputted from the first main assembly drive transmission member to the drum coupling of the drum 11, so that the drum 11 is rotationally driven in the clockwise direction indicated by an arrow R11. The charging roller 14 is rotated by rotation of the drum 11. To the charging roller 14, a predetermined charging bias is applied from an output electric contact via an input electric contact. As a result, the peripheral surface of the drum 11 is contact-charged uniformly to a predetermined polarity and a predetermined potential.

Further, the developing roller 21 and application roller 22 of the developing unit D are rotationally driven in the counterclockwise direction indicated by arrows R21 and R22 at a predetermined peripheral speed by inputting the driving force from the second main assembly drive transmission member to the developing device driving force input portion. Further, the stirring member 31 is rotationally driven in the clockwise direction indicated by an arrow R31 at a predetermined speed. By the rotation of the stirring member 31, the toner 100 in the toner accommodating chamber 30 is scooped up and is fed into the developing chamber 24 through the operating 24*a*, thus being supplied onto the application roller 22.

Further, a toner layer in a predetermined thickness is formed on the surface of the developing roller 22 by the application roller 22 and the developing blade 23. The toner supplied to the developing roller 21 is triboelectrically charged to a predetermined polarity by the developing blade 23.

To the developing roller 21, a predetermined developing bias is applied from an output electric contact via an input electric contact. Then, at a developing portion as a contact portion between the drum 11 and the developing roller 21, the toner of the toner layer formed on the developing roller 21 is selectively deposited on the electrostatic latent image formed on the surface of the drum 11 by the charging and the exposure. As a result, the electrostatic latent image on the surface of the drum 11 is developed as the toner image, and at the primary transfer portion, the toner image is primary-transferred onto the belt 4*d*.

The toner remaining on the surface of the drum 11 without being transferred on the belt 4*d* is scraped off from the surface of the drum 11 by the cleaning blade 12 and then is accommodated in a residual toner containing portion 13 in the cleaning frame 10. As a result, the drum 11 is cleaned and is repetitively subjected to image formation.

3. Structure of Developing Unit D

Next, the developing unit D with which the toner accommodating unit E is integrally provided will be described. The developing unit D is roughly divided into and constituted by two parts. A first part is the developing chamber 24 in which the developing means including the developing roller 21, the application roller 22, the developing blade 23 and the like is disposed. A second part is the toner accommodating unit E in which the toner 100 is accommodated and is stirred by the stirring member 31 and then is fed to the developing chamber 24.

Further, although will be specifically described in a structure of the toner accommodating unit E described later, on a side wall 30*a* (located with respect to a rotation radius direction of the stirring member 31) of the toner accommodating chamber 30, a remaining amount detecting means 40 for detecting the remaining amount of the accommodated toner 100 is provided. Incidentally, in this embodiment, the frame of the developing chamber 24 and the frame of the toner accommodating unit E are constituted by the same developing device frame 20 but are not limited thereto.

Next, with reference to FIG. 4, an operation of the developing unit D will be described. Incidentally, in this embodiment, description relating to a toner stirring/supplying operation principally by rotation of the stirring member 31 is made and therefore a structure of the remaining amount detecting means 40 will be described in the structure of the toner accommodating unit described later.

When the stirring member 31 is rotated from a rotation angle position of (a) of FIG. 4, the toner 100 in the toner accommodating chamber 30 of the toner accommodating unit E is pushed by the stirring blade 31*b* as shown in (b) of FIG. 4, thus being moved toward the side wall 30*a* on a bottom 30*b* of the toner accommodating chamber 30. When the stirring member 31 is further rotated, the toner in the toner accommodating chamber 30 is raised and conveyed along the side wall 30*a* by the stirring blade 31*b* as shown in (c) of FIG. 4.

Then, a part of the raised and conveyed toner 100 is sent into the developing chamber 24*a* through the operating 24 as shown in (d) of FIG. 4, thus being supplied to the application roller 22. Further, the toner which is not sent into the developing chamber 24*a* is dropped and accumulated at the bottom 30*b* of the toner accommodating chamber 30 and then is returned to the state of (a) of FIG. 4.

Thus, by repetition of the above-described cycle by the rotation of the stirring member 31, the stirring of the toner 100 in the toner accommodating chamber 30 and the toner supply to the developing chamber 24 are effected. The toner supplied to the developing chamber 24 is, as described above, used for development of the latent image on the drum 11 by the developing means 21 to 23.

4. Structure of Toner Accommodating Unit E

Next, the structure of the toner accommodating unit E will be described with reference to FIGS. 5 to 8. Particularly, in this embodiment, the structure of the remaining amount detecting means 40 provided through the toner accommodating unit E will be described.

First, a light guide member 41, constituting the remaining amount detecting means 40, for remaining toner amount detection will be described. FIG. 5 is a perspective view of the remaining amount detecting means 40 as seen from an outside of the toner accommodating chamber 30, and FIG. 6 is a perspective view of the remaining amount detecting means 40 as seen from an inside of the toner accommodating chamber 30. As shown in FIGS. 5 and 6, on the side wall 30*a* of the toner accommodating chamber 30, the remaining amount detecting means 40 for detecting the remaining amount of the toner is provided.

Further, outside the toner accommodating unit E, the light emitting element 50 such as the LED and the light receiving element 51 such as the photo-transistor which are provided in the image forming apparatus main assembly A1 side are provided. The remaining amount detecting means 40 is constituted by the light guide member 41 and a light guide member mounting portion 24 as a part of the developing device frame 20 described later.

FIG. 7 is a schematic view of the light guide member 41 as seen from the outside of the toner accommodating chamber 30. With reference to FIGS. 6 and 7, the structure of the light guide member 41 will be described. The light guide member 41 is prepared by integrally forming, with a transparent member, a light-incident-side light guide portion 41*a* for guiding detection light 52 coming from the light emitting element 50 into the toner accommodating chamber 30 and a light-emergent-side light guide portion 41*b* for guiding the detection light 52 having passed through the inside of the toner accommodating chamber 30 to the light receiving element 51.

The light-incident-side lighting guide portion 41*a* includes an incident portion 41*c* on which the detection light 52 coming from the light emitting element 50 is incident and includes a light-emergent-side window 41*d* through which the detection light 52 which enters the light-incident-side light guide portion 41*a* emerges into the developer accommodating chamber 30. Similarly, the light-emergent-side light guide portion 41*b* includes a light-incident-side window 41*e* on which the detection light 52 having passed through the inside of the developer accommodating chamber 30 is incident and includes an emergent portion 41*f* from which the detection light 52 having entered the light-emergent-side light guide portion 41*b* emerges toward the light receiving element 51.

The light-emergent-side window 41*d* and the light-incident-side window 41*e* are disposed opposed to each other, and between these windows, an optical path 53 along which the detection light 52 passes is formed. However, in the case where the optical path 53 is formed in consideration of light refraction generated during the emission of the light from the light-emergent-side window 41*d* and during the incidence of the light on the light-incident-side window 41*e*, the present invention is not limited to the constitution in which the light-emergent-side window 41*d* and the light-incident-side window 41*e* are disposed opposed to each other.

The light guide member 41 includes a light guide member mounting portion 41*g* for positioning the light guide member 41 by being engaged with a developing device frame positioning portion 24*a* (FIG. 9) of a first developing device frame 20*a* (FIG. 8) described later. Further, the light guide member 41 includes a surface-to-be-welded d41*h* used during connection with the first developing device frame 20*a* by ultrasonic welding described later.

Next, with reference to FIGS. 8 and 9, the developing device frame 20 will be described. Here, the developing device frame 20 is in general constituted by a plurality of two or more frames in many cases. Also in the case of the developing device frame 20 in this embodiment, as shown in FIG. 8, the developing device frame 20 is constituted by connecting a first developing device frame 20*a* and a second developing device frame 20*b*, which are divided from the developing device frame 20, through a means such as ultrasonic welding. In this embodiment, the frame on which the remaining amount detecting means 40 is mounted is referred to as the first developing device frame 20*a*.

FIG. 9 is a schematic view of the remaining amount detecting means 40 and its periphery on the first developing device frame 20*a*, in a state before the light guide member 41 is mounted, as seen from the inside of the toner accommodating chamber 30. On the first developing device frame 20*a*, the light guide member mounting portion 24 for mounting the light guide member 41 on the side wall 30*a* corresponding to the inside portion of the developer accommodating chamber 30 is provided. The light guide member mounting portion 24 includes the developing device frame positioning portion 24*a* corresponding to the light guide member positioning portion 41*g*.

Further, at a position corresponding to the surface-to-be-welded 41*h*, a welding rib 24*b* used during connection with the light guide member 41 by the ultrasonic welding is provided. Inside a region surrounded by the welding rib 24*b*, an incident side opening 24*c* and an emergent side opening 24*d* for permitting exposure of the incident portion 41*c* and the emergent portion 41*f*, respectively, to the outside are provided. A portion other than the incident portion 24*c* and the emergent side opening 41*f* constitutes a cover portion 24*e* for covering the outer wall other than the incident portion 41*c* and the emergent portion 41*f* when the light guide member 41 is mounted. Incidentally, the outer wall of the first developing device frame 20*a* is formed in a surface state in which a light reflectance is lower than that at the outer wall of the light guide member 41.

Next, with reference to FIGS. 10, 11 and 12, a state in which the light guide member 41 is molded on the first developing device frame 20*a* will be described. FIG. 10 is a schematic view, as seen from the outside of the toner accommodating chamber 30, of the first developing device frame 20*a* on which the light guide member 41 is mounted. FIGS. 11 and 12 are X-X cross-sectional view and Y-Y cross-sectional view, respectively in FIG. 10, of the first developing device frame 20*a* on which the light guide member 41 is mounted.

As shown in FIGS. 10, 11 and 12, in the state in which the light guide member 41 is mounted on the first developing device frame 20*a*, the light guide member 41 is in a state in which the incident portion 41*c* and the emergent portion 41*f* are exposed to the outside of the toner accommodating chamber 30. On the other hand, other portions are in a state in which the portions are covered with the first developing device frame 20*a*. However, within a range not adversely affecting accuracy of the remaining amount detection, a portion corresponding to a portion in the neighborhood of the incident portion 41*c* and the emergent portion 41*f*, e.g., a part of the surface adjacent to the incident portion 41*c* and the emergent portion 41*f* may also be exposed to the outside of the toner accommodating chamber 30.

In this embodiment, as shown in FIGS. 11 and 12, the light guide member 41 is connected with the first developing device frame 20*a* by the ultrasonic welding. The connection by the ultrasonic welding is effected by engaging and positioning first the light guide member positioning portion 41*g* of the light guide member 41 with the developing device frame positioning portion 24*a* of the developing device frame

20*a*. Thereafter, in a state in which a back surface of the surface-to-be-welded 41*h* of the light guide member 41 is backed up, a back side of the welding rib 24*b* of the first developing device frame 20*a* is vibrated by an ultrasonic vibrating device. At this time, the welding rib 24*b* generates heat and melts, thus being in a state, as shown in FIG. 10, in which the light guide member 41 and the first developing device frame 20*a* are connected at a welding portion 24*f*.

In FIG. 10, the welding portion 24*f* is indicated by a broken line since a state thereof as seen via the first developing device frame 20*a* is illustrated. As shown in FIG. 10, the incident side opening 24*c* and the emergent side opening 24*d* are located inside the welding portion 24*f* and therefore the toner is not leaked from the inside to outside of the toner accommodating chamber 30. Further, the incident portion 41*c* and the emergent portion 41*f* of the light guide member 41 are, when viewed from a direction normal to the surface-to-be-welded 41*h*, disposed in an inside range of the welding rib 24*b* (inside the welding range). As a result, during the welding, the back side of the welding rib 24*b* is directly vibrated easily, so that stable welding accuracy can be ensured.

As described above, the light guide member 41 as the remaining amount detecting means is mounted on the first developing device frame 20*a* as the developer accommodating frame in a state in which the incident portion 41*c* and the emergent portion 41*f* are exposed from the incident side opening 24*c* and the emergent side opening 25*d*, respectively. Further, the light guide member 41 and the first developing device frame 20*a* are connected in a sealed state by welding so that the outside and inside of the toner accommodating chamber 30 do not communicate with each other via the incident side opening 24*c* and the emergent side opening 24*d*. The incident portion 41*c* and the emergent portion 41*f* are located inside the welding range when viewed from the direction normal to the welding surface.

The connection between the light guide member 41 and the first developing device frame 20*a* as the developer accommodating frame may also be performed by a method other than the welding. These members may also be connected in a state in which there members are sealed by a sealing means.

Further, as shown in FIG. 12, a portion of the light guide member 41 covered with the covering portion 24*e* is not directly subjected to impact from the outside. Accordingly, excessive strength is not needed, so that it is also possible to make a thickness t1 small in consideration of space saving or the like. On the other hand, the cover portion 24*e* is used for covering the light guide member 41 and therefore also the cover portion 24*e* is not required to have excessive strength, so that a thickness t2 can be made small in consideration of space saving or the like.

5. Remaining Amount Detecting Method and Influence of Stray Light

A remaining amount detecting method by the remaining amount detecting means 40 will be described with reference to FIGS. 1, 6, 13 and 14. FIG. 1 is an outer appearance showing a state during the remaining amount detection. In FIG. 1, in order to distinguish the first developing device frame 20*a* from the light guide member 41, the outer wall of the first developing device frame 20*a* including the cover portion 24*a* is crosshatched.

In a state in which the process cartridge B including the developing unit D is mounted at a predetermined mounting portion of the image forming apparatus main assembly A1 in a predetermined manner, with respect to the light emitting element 50 and light receiving element 51 in the image forming apparatus main assembly A1 side, the remaining amount detecting means 40 provided through the toner accommodating unit E is positioned correspondingly. That is, as shown in FIG. 1, with respect to the light emitting portion of the light emitting element 50, the incident portion 40*c* of the light guide member 41 is located at an opposing. Further, with respect to the light receiving potion of the light receiving element 51, the emergent portion 41*f* of the light guide member 41 is located at an opposing position.

When the remaining amount detection is performed, the detection light 52 is emitted from the light emitting element 50. The emitted detection light 52 is incident on the incident portion 41*c* exposed to the outside of the cartridge and then is guided from the light-emergent-side window 41*d* to the inside of the toner accommodating chamber 30 as shown in FIG. 6. Then, the detection light 52 having passed through the light-emergent-side window 41*d* enters the light-incident-side window 41*e* disposed opposed to the light-emergent-side window 41*d*. At this time, an optical path 53 is formed between the light-emergent-side window 41*d* and the light-incident-side window 41*e*.

Thereafter, the detection light 52 having entered the light-incident-side window 41*e* emerges from the emergent portion 41*f* toward the light receiving element 51, thus being received by the light receiving element 51. The control circuit portion (not shown) detects passing of the detection light 52 through the inside of the toner accommodating chamber 30 by a light receiving signal of the light receiving element 51.

Here, a light transmission type remaining developer amount detecting method in this embodiment will be described. FIG. 13 shows Z-Z cross section of FIG. 1 in a state in which the toner 100 passes on the remaining amount detecting means 40, and FIG. 14 shows Z-Z cross section of FIG. 1 immediately after the toner 100 passes on the remaining amount detecting means 40.

During a period in which there is no toner 100 on the remaining amount detecting means 40, a state in which the optical path 53 is formed is created, but as shown in FIG. 13, during passing of the toner on the remaining amount detecting means 40, the optical path 53 is blocked by the toner, so that the detection light 52 is placed in a state in which the detection light 52 is not detected by the light receiving element 51.

Thereafter, as shown in FIG. 14, when the toner completely passes on the remaining amount detecting means 40, the optical path 53 is formed again, so that the detection light 52 is placed in a detectable state by the light receiving element 51. In this case, when the remaining toner amount in the toner accommodating chamber 30 is large, the amount of the toner 100 passing on the remaining amount detecting means 40 is also large and a passing time becomes long, and therefore a blocking time of the optical path 53 also becomes long.

On the other hand, in a state in which the remaining toner amount is small, the amount of the toner 100 passing on the remaining amount detecting means 40 is small and the passing time becomes short, and therefore the blocking time of the optical path 53 also becomes short. Thus, a length of time in which the light receiving element 51 can receive the light varies depending on the remaining toner amount in the toner accommodating chamber 30. The control circuit portion is capable of detecting the remaining amount of the toner 100 from the blocking time of the detection light 52.

That is, control circuit portion estimates the remaining toner amount by using a change, depending on the toner amount in the toner accommodating chamber 30, in light-blocking time and light transmission time of the optical path 53 detected by the light receiving element 51 by flow of the toner 100 on the remaining amount detecting means 40 with rotation of the stirring member 13. Then, the estimated remaining toner amount and a predetermined threshold are compared, so that pre-warning or warning of end of a lifetime of the cartridge B is provided at a display portion of an operating portion (not shown) of the image forming apparatus or at a display portion of an external host device (not shown) and thus an operator (user) is urged to prepare a new cartridge B or replace the old cartridge B with the new cartridge B.

Here, when the toner 100 passes on the remaining amount detecting means 40, in many cases, the toner is deposited on the light-emergent-side window 41*d* and the light-incident-side window 41*e* to obstruct the passing of the detection light 52. As a result, the blocking time of the detection light 52 becomes larger than that in a normal state and therefore an accurate remaining amount of the toner cannot be detected.

Therefore, as shown in FIG. 14, the stirring shaft 31*a* is provided with a cleaning means 31*c*, constituted by a sheet member or the like, for removing the toner deposited on the light-emergent-side window 41*d* and the light-incident-side window 41*e*. The cleaning means 31*c* is, in order to minimize the lowering in detection accuracy due to the toner deposition, disposed at a phase where the cleaning means 31*c* can quickly wipe the toner off the light-emergent-side window 41*d* and the light-incident-side window 41*e* after the stirring blade 31*b* conveying the toner passes on the remaining amount detecting means 40.

Next, with reference to FIG. 1, the influence of stray light during the remaining amount detection and a stray light-preventing effect in this embodiment will be described. As shown in FIG. 1, in many cases the light emitted from the light emitting element 50 is in general diffused light 54, and the detection light 52 passing toward the incident portion 41*c* is also part of the diffused light 54. Accordingly, in a conventional constitution, the diffused light 54 was reflected by the outer wall of the light guide member 41 and then was detected by the light receiving element 51 without passing through the inside of the light guide member 41. This is because the outer wall of the light guide member 41 generally has a surface property such that a reflectance is high.

However, in this embodiment, the light guide member 41 is in a state in which the outer wall thereof other than the incident portion 41*c* and the emergent portion 41*f* is covered with the cover portion 24*e*. As described above, the cover member 24*e* is in a surface state in which the reflectance is lower than that of the outer wall of the light guide member 41 and therefore the reflection of the diffused light 54 vis regulated by the cover portion 24*e*, so that it is possible to suppress erroneous detection of the light by the light receiving element 51.

Further, in the image forming apparatus, the diffused light 54 is repeatedly reflected in a complicated manner to constitute stray light 55 in some cases. There is also the case where such stray light 55 is provided by another light emitting element mounted to the image forming apparatus. In the conventional constitution, the stray light 55 had a possibility that it enters the inside of the light guide member 41 from a portion other than the incident portion 41*c* to increase a light quantity and thus adversely affects the remaining amount detection accuracy.

However, in this embodiment, the light guide member 41 is covered with the cover portion 24*e* at its out wall other than the incident portion 41*c* and the emergent portion 41*f*, and therefore it is possible to suppress the influence, on the remaining amount detection accuracy, of the stray light 55 entering the inside of the light guide member 41 from a portion other than the incident portion 41*c*.

As described above, according to this embodiment, it is possible to suppress the lowering in remaining amount detection accuracy caused by the diffused light 54 which is emitted from the light emitting element 50 and which is reflected by the outer wall of the light guide member 41 and then is received by the light receiving element 51. Further, it becomes possible to suppress the lowering in remaining amount detection accuracy caused by the stray light 55 which increases the light quantity of the light passing through the light guide member 41.

Further, by mounting the light guide member 41 to the developing device frame 20 from the inside of the toner accommodating chamber 30, the outer wall other than the incident portion 41*c* and the emergent portion 41*f* is covered with the developing device frame 20. For that reason, there is no need to provide a new cover member and thus it becomes possible to suppress the number of parts and a cost.

As described above, it is possible to provide the developer accommodating unit capable of satisfactorily detecting the remaining amount of the developer while suppressing an increase in cost and more suppressing the influence of the stray light, and to provide the developing cartridge, the process cartridge and the image forming apparatus which include the developer accommodating unit.

According to the present invention, in the case where the light guide member for detecting the remaining developer amount is integrally formed, it is possible to provide the developer accommodating unit capable of satisfactorily detecting the remaining amount detection of the developer while suppressing the increase in cost and more suppressing the influence of the stray light. In addition, it is possible to provide the developing cartridge, the process cartridge and the image forming apparatus which include the developer accommodating unit.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 092800/2012 filed Apr. 16, 2012, which is hereby incorporated by reference.

What is claimed is:

1. A developer accommodating unit, usable with an electrophotographic image forming apparatus, for accommodating developer for an electrophotographic image forming process, said developer accommodating unit comprising:

a developer accommodating chamber, formed by a developer accommodating frame, for accommodating the developer; and a light guide member, provided through said developer accommodating frame, for detecting a remaining toner amount, wherein said light guide member includes (i) a light-incident-side light guide portion for guiding detection light coming from a light emitting element provided outside of said developer accommodating chamber to an inside of said developer accommodating chamber and (ii) a light-emergent-side light guide portion for guiding the detection light passed through the inside of said developer accommodating chamber to a light receiving element provided outside of said developer accommodating chamber, said light-incident-side light guide portion and said light-emergent-side light guide portion being integrally formed, wherein said light-incident-side light guide portion includes an incident portion on which the detection light is incident, and includes a light-emergent-side window through which the detection light emerges into said developer accommodating chamber, wherein said light-emergent-side light guide portion includes a light-incident-side window on which the detection light passed through the inside of said developer accommodating chamber is incident, and includes an emergent portion from which the detection light emerges toward the light receiving element, wherein said developer accommodating frame includes a light guide member mounting portion for mounting said light guide member, said light guide member mounting portion including an incident side opening and an emergent side opening for exposing said incident portion and said emergent portion, respectively, to the outside of said developer accommodating chamber, said light guide member mounting portion being provided on an inner side wall of said developer accommodating chamber, and wherein said light guide member (i) is mounted to said developer accommodating frame in a state in which said incident portion and said emergent portion are exposed through the incident side opening and the emergent side opening, respectively and (ii) is connected with said developer accommodating frame in a sealed state so that the outside and inside of said developer accommodating chamber are prevented from communicating with each other via the incident side opening and the emergent side opening.

2. A developer accommodating unit according to claim 1, wherein said light guide member is connected to said developer accommodating frame in the sealed state by welding, and wherein said incident portion and said emergent portion are located inside a welding range when viewed from a direction normal to a welding surface.

3. A developing cartridge detachably mountable to a main assembly of an electrophotographic image forming apparatus, said developing cartridge comprising:

developing means for developing a lateral image formed on an electrophotographic photosensitive drum; and a developer accommodating unit according to claim 1.

4. A process cartridge detachably mountable to a main assembly of an electrophotographic image forming apparatus, said process cartridge comprising:

an electrophotographic photosensitive drum;

developing means for developing, with developer, a latent image formed on said electrophotographic photosensitive drum; and a developer accommodating unit in which the developer is accommodated, wherein said developer accommodating unit comprises:

a developer accommodating chamber, formed by a developer accommodating frame, for accommodating the developer; and a light guide member, provided through said developer accommodating frame, for detecting a remaining toner amount, wherein said light guide member includes (i) a light-incident-side light guide portion for guiding detection light coming from a light emitting element provided outside of said developer accommodating chamber to an inside of said developer accommodating chamber and (ii) a light-emergent-side light guide portion for guiding the detection light passed through the inside of said developer accommodating chamber to a light receiving element provided outside of said developer accommodating chamber, said light-incident-side light guide portion and said light-emergent-side light guide portion being integrally formed, wherein said light-incident-side light guide portion includes an incident portion on which the detection light is incident, and includes a light-emergent-side window through which the detection light emerges into said developer accommodating chamber, wherein said light-emergent-side light guide portion includes a light-incident-side window on which the detection light passed through the inside of said developer accommodating chamber is incident, and includes an emergent portion from which the detection light emerges toward the light receiving element, wherein said developer accommodating frame includes a light guide member mounting portion for mounting said light guide member, said light guide member mounting portion including an incident side opening and an emergent side opening for exposing said incident portion and said emergent portion, respectively, to the outside of said developer accommodating chamber, said light guide member mounting portion being provided on an inner side wall of said developer accommodating chamber, and wherein said light guide member (i) is mounted to said developer accommodating frame in a state in which said incident portion and said emergent portion are exposed through the incident side opening and the emergent side opening, respectively and (ii) is connected with said developer accommodating frame in a sealed state so that the outside and inside of said developer accommodating chamber are prevented from communicating with each other via the incident side opening and the emergent side opening.

5. A process cartridge according to claim 4, wherein said light guide member is connected to said developer accommodating frame in the sealed state by welding, and wherein said incident portion and said emergent portion are located inside a welding range when viewed from a direction normal to a welding surface.

6. An image forming apparatus for forming an image on a recording material, said image forming apparatus comprising:

an electrophotographic photosensitive drum;

developing means for developing, with developer, a latent image formed on said electrophotographic photosensitive drum; and a developer accommodating unit for accommodating the developer, wherein said developer accommodating unit comprises:

a developer accommodating chamber, formed by a developer accommodating frame, for accommodating the developer; and a light guide member, provided through said developer accommodating frame, for detecting a remaining toner amount, wherein said light guide member includes (i) a light-incident-side light guide portion for guiding detection light coming from a light emitting element provided outside of said developer accommodating chamber to an inside of said developer accommodating chamber and (ii) a light-emergent-side light guide portion for guiding the detection light passed through the inside of said developer accommodating chamber to a light receiving element provided outside of said developer accommodating chamber, said light-incident-side light guide portion and said light-emergent-side light guide portion being integrally formed, wherein said light-incident-side light guide portion includes an incident portion on which the detection light is incident, and includes a light-emergent-side window through which the detection light emerges into said developer accommodating chamber, wherein said light-emergent-side light guide portion includes a light-incident-side window on which the detection light passed through the inside of said developer accommodating chamber is incident, and includes an emergent portion from which the detection light emerges toward the light receiving element, wherein said developer accommodating frame includes a light guide member mounting portion for mounting said light guide member, said light guide member mounting portion including an incident side opening and an emergent side opening for exposing said incident portion and said emergent portion, respectively, to the outside of said developer accommodating chamber, said light guide member mounting portion being provided on an inner side wall of said developer accommodating chamber, and wherein said light guide member (i) is mounted to said developer accommodating frame in a state in which said incident portion and said emergent portion are exposed through the incident side opening and the emergent side opening, respectively and (ii) is connected with said developer accommodating frame in a sealed state so that the outside and inside of said developer accommodating chamber are prevented from communicating with each other via the incident side opening and the emergent side opening.

7. An image forming apparatus according to claim 6, wherein said light guide member is connected to said developer accommodating frame in the sealed state by welding, and wherein said incident portion and said emergent portion are located inside a welding range when viewed from a direction normal to a welding surface.

8. A developer accommodating unit comprising:

a developer accommodating chamber, formed by a developer accommodating frame, for accommodating developer; and a light guide member, provided through said developer accommodating frame, for detecting a remaining toner amount, wherein said developer accommodating frame includes an cover portion covering a part of said light guide member, wherein said light guide member includes a light guide member mounting portion for positioning said light guide member by being welded with said cover portion, and wherein said light guide member mounting portion is provided inside of said cover portion.

9. A developer accommodating unit according to claim 8, wherein said light guide member is connected with the developer accommodating frame in a sealed state by welding, and wherein said light guide member includes an incident portion and an emergent portion that are located inside a welding range when viewed from a direction normal to a welding surface.

10. A developing cartridge detachably mountable to a main assembly of an electrophotographic image forming apparatus, said developing cartridge comprising:

developing means for developing a lateral image formed on an electrophotographic photosensitive drum; and a developer accommodating unit according to claim 8.

11. A process cartridge, detachably mountable to a main assembly of an electrophotographic image forming apparatus, said process cartridge comprising:

an electrophotographic photosensitive drum;

developing means for developing, with a developer, a latent image formed on said electrophotographic photosensitive drum; and a developer accommodating unit according to claim 8.

12. An image forming apparatus, for forming an image on a recording material, said image forming apparatus comprising:

an electrophotographic photosensitive drum;

developing means for developing, with developer, a latent image formed on said electrophotographic photosensitive drum; and a developer accommodating unit according to claim 8.

13. A developer accommodating unit according to claim 8, wherein said light guide member includes (i) a light-incident-side light guide portion for guiding detection light coming from a light emitting element provided outside of said developer accommodating chamber to an inside of said developer accommodating chamber and (ii) a light-emergent-side light guide portion for guiding the detection light passed through the inside of said developer accommodating chamber to a light receiving element provided outside of said developer accommodating chamber.

14. A developer accommodating unit according to claim 13, wherein said light-incident-side light guide portion and said light-emergent-side light guide portion are integrally formed.

15. A developer accommodating unit according to claim 8, wherein said light guide member is mounted to said developer accommodating frame in a state in which an incident portion and an emergent portion are exposed through an incident side opening and an emergent side opening, respectively.

16. A developer accommodating unit according to claim 8, wherein said light guide member is connected to said developer accommodating frame in a sealed state so that the outside and inside of said developer accommodating chamber are prevented from communicating with each other via an incident side opening and an emergent side opening.

* * * * *